US010864752B2

(12) United States Patent
Vidal Alvarez et al.

(10) Patent No.: US 10,864,752 B2
(45) Date of Patent: Dec. 15, 2020

(54) PRINTING ON RIGID AND FLEXIBLE PRINT MEDIA

(71) Applicant: Hewlett-Packard Development Company, L.P., Houston, TX (US)

(72) Inventors: Pablo Vidal Alvarez, Sant Cugat del Valles (ES); Antonio Monclus Velasco, Sant Cugat del Valles (ES); Emilio Angulo Navarro, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/009,889

(22) Filed: Jun. 15, 2018

(65) Prior Publication Data

US 2019/0381809 A1 Dec. 19, 2019

(51) Int. Cl.

| | |
|---|---|
| ***B41J 11/02*** | (2006.01) |
| ***B41J 11/00*** | (2006.01) |
| ***B41M 7/00*** | (2006.01) |

(52) U.S. Cl.

CPC ..... *B41J 11/002* (2013.01); *B41M 7/009* (2013.01)

(58) Field of Classification Search

CPC ..... B41M 7/009; B41J 11/002

See application file for complete search history.

(56) References Cited

U.S. PATENT DOCUMENTS

| | | | | |
|---|---|---|---|---|
| 5,086,700 | A | 2/1992 | Van Den Berg | |
| 6,256,903 | B1 | 7/2001 | Rudd | |
| 6,463,674 | B1 | 10/2002 | Meyers et al. | |
| 6,536,863 | B1 | 3/2003 | Beauchamp et al. | |
| 6,813,846 | B2 | 11/2004 | Yoshida | |
| 6,863,393 | B2 | 3/2005 | Patterson | |
| 2002/0097311 | A1 * | 7/2002 | Hinojosa | B41J 11/0025 347/104 |
| 2003/0170306 | A1 * | 9/2003 | Raether | C08F 293/00 424/484 |
| 2010/0066783 | A1 * | 3/2010 | Navazo | B41J 11/002 347/17 |
| 2013/0232812 | A1 * | 9/2013 | Kampris | D21F 5/188 34/444 |
| 2014/0009546 | A1 * | 1/2014 | Velasco | B41J 11/002 347/102 |

(Continued)

FOREIGN PATENT DOCUMENTS

| | | | |
|---|---|---|---|
| CN | 105398236 | A | 3/2016 |
| JP | 4800087 | B2 | 10/2011 |
| JP | 2014176980 | A * | 9/2014 |

OTHER PUBLICATIONS

Chiwata, MachineTranslationof JP2014-176980A (Year: 2014).*

*Primary Examiner* — Scott A Richmond

(74) *Attorney, Agent, or Firm* — HP Inc. Patent Department

(57) ABSTRACT

A printing device is described. The printing device comprises a fluid flow generator to cause a heating fluid to flow towards a curing zone that is downstream of a print zone in terms of an advance direction of the print medium. The printing device comprises an impingement device arranged upstream of the curing zone in terms of the heating fluid flow. The impingement device is to modify a flow rate of the heating fluid towards the curing zone along the advance direction.

18 Claims, 9 Drawing Sheets

(56) References Cited

U.S. PATENT DOCUMENTS

| | | | | |
|---|---|---|---|---|
| 2014/0028767 | A1* | 1/2014 | Velasco | B41J 11/001 347/102 |
| 2014/0208607 | A1* | 7/2014 | Navazo | F26B 21/12 34/487 |
| 2017/0087874 | A1* | 3/2017 | Maida | B41J 11/002 |

* cited by examiner

PRINTING ON RIGID AND FLEXIBLE PRINT MEDIA

BACKGROUND

Printing devices may operate to spray a print fluid including pigment particles over a surface over print medium to be printed. Some print fluids may further include additional particles that can be polymerized to support the adhesion of the pigment particles to the surface. The polymerization of the additional particles may be performed by the exposure to an external energy source.

DESCRIPTION OF THE EXAMPLES

In the following, examples of a printing device and a method are described that may allow for printing on both flexible and rigid print media in a satisfactory manner. The print media may be made from various materials. As described below, an exemplary printing devices may comprise an impingement device. The impingement device may have the structural and/or functional features allowing for modifying the flow of a heating fluid towards a curing zone, through which a print medium is to be conveyed, along an advanced direction of the print medium. As a result, the printing device may provide for heating fluid impingement onto the print medium. The heating fluid impingement may be used for curing additional particles contained in a print fluid in a well-defined manner.

The print fluid may contain pigment particles carrying a color and additional particles to support the adhesion of the pigment particles to the surface of the print medium. For example, the additional particles may be polymerizable by applying heat. It may be advantageous to apply heat to the print fluid in a defined matter, in particular in terms of the heating speed. For example, if heated up too fast, the additional particles at a surface of the print fluid that is proximal to the heat source may be polymerized, whereas the additional particles below this surface remain unaffected. Furthermore, an excessive heating may deteriorate the print medium. Slowing down the heating of the print fluid, on the other hand, may decrease the throughput and the performance of the printing device as a whole.

According to the present disclosure, the impingement device modifying the heating fluid flow may be useful for quickly heating up the print fluid to a desired temperature and maintaining this temperature for a desired duration. The present disclosure may allow for durable printing on both flexible and rigid printing media made from different materials. Furthermore, the subject matter disclosed herein may allow for printing on flexible and rigid printing media made from different materials with a satisfactory gloss.

Figure 1:
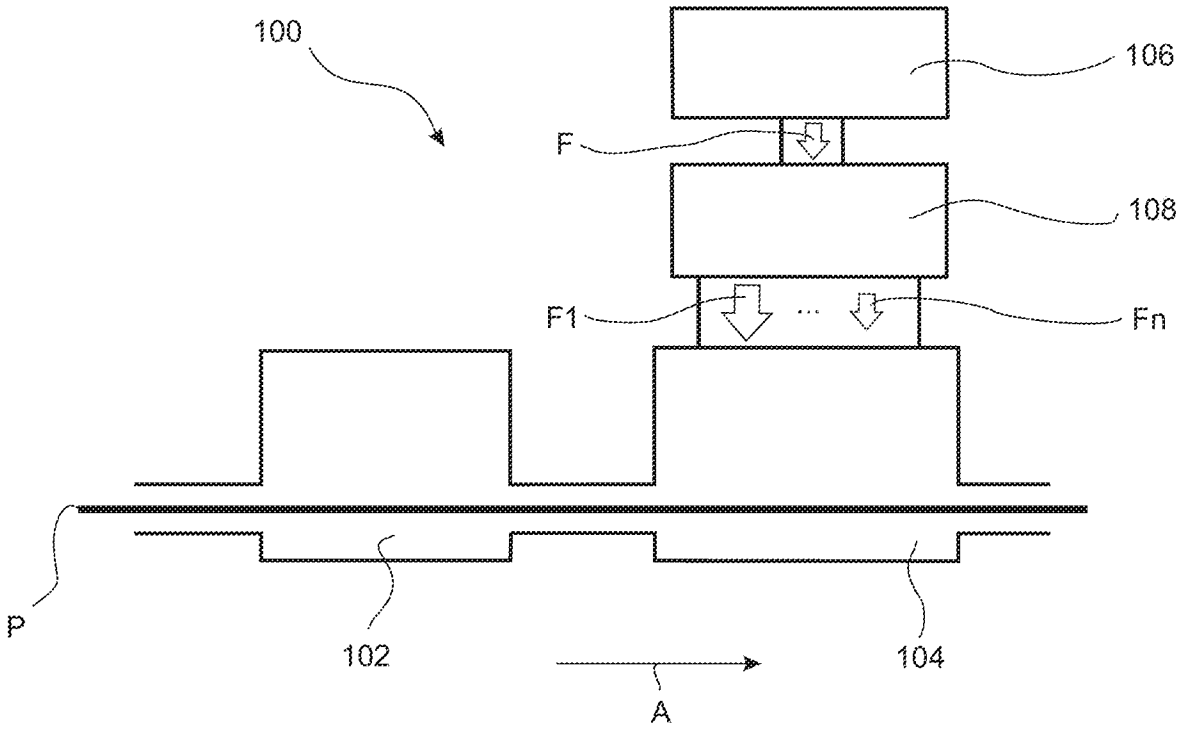
FIG. 1 is a schematic diagram of a printing device according to an example.

FIG. 1 shows a schematic diagram of a printing device 100 according to an example. The printing device 100 may comprise a print zone 102 and a curing zone 104. A print medium P may be moved subsequently through the print zone 102 and the curing zone 104 along a direction A, referred to as advance direction A of the print medium P. Accordingly, the curing zone 104 may be arranged downstream of the print zone 102 in terms of the advance direction A.

The print zone 102 and the curing zone 104 may be implemented each in a closed volume, in a semi-closed volume, or in an open volume. The print zone 102 and the curing zone 104 may be openly connected to each other, for example, without a separating structure therebetween. Alternatively, as shown in FIG. 1, print zone 102 and the curing zone 104 may be connected via a conduit.

The printing device 100 may operate to dispose a print fluid on the surface of the print medium P within the print zone 102. The print fluid (not shown) may contain pigment particles and additional particles, such as a polymer component. Each of the pigment particles may carry a color, for example, cyan, magenta, yellow, or key (black). In the curing zone 104, the print fluid disposed on the surface of the print medium P may be processed such as to support the adhesion of the pigment particles to the surface of the print medium P.

The additional particles may support the adhesion of the pigment particles to the surface of the print medium P. For example, the additional particles in the print fluid may be polymerizable such as to form chain-like structures. For example, the additional particles in the print fluid are to coalesce under heat. For example, the additional particles may comprise latex-like or latex-based contents. Such a print fluid may be referred to as a Latex Ink. Examples for a print fluid are described in WO 2010/151264, WO 2010/151266, WO 2012/148421 A1, WO 2013/122601 A1, or WO 2015/084395 A1. The heat used for the polymerization and/or the coalescence of the additional particles may be transferred from the heating fluid to the print medium P within the curing zone 104. In some examples, the print fluid may contain a polymer component to coalesce when exposed to the heating fluid at a curing temperature, which, for example, may be 30-200° C., or 40-150° C., or 50-100° C.

For example, either ones of the pigment particles and the additional particles of the print fluid may be encapsuled. The heat transferred from the heating fluid may penetrate other co-solvents and fluid components, such as water or water-based components, of the print fluid due to an increased flow velocity of the heating fluid towards the print fluid. The flow of the heating fluid with an increased flow velocity towards the printing medium, or the print fluid disposed thereupon, may be referred to as impingement.

The impingement may be created by, for instance, increasing the pressure of the heating fluid on the upstream side of the impingement device in terms of the heating fluid flow, and reducing the cross-sectional area of the passage for the heating fluid through an impenetrable structure. In this manner, nozzles, in principle, for directing, focusing and/or accelerating the heating fluid towards the curing zone may be provided.

The printing device 100 further comprises a fluid flow generator 106 to cause the heating fluid to flow towards the curing zone 104. Accordingly, the impingement device 108 may be arranged upstream of the curing zone 104 in terms of the heating fluid flow. In FIG. 1, the flow of the heating fluid is indicated by arrow F. In some examples, the heating fluid is air, in particular, ambient air.

The printing device 100 further comprises an impingement device 108 arranged upstream of the curing zone 104 in terms of the heating fluid flow F. For example, the impingement device 108 may be arranged downstream of the fluid flow generator 106 in terms of the heating fluid flow F, as shown in FIG. 1. The fluid flow generator 106, the impingement device 108, and the curing zone 104 may be fluidly connected to one another such as to allow the heating fluid to flow from one to another. For example, the heating fluid may flow from the fluid flow generator 106 to the curing zone 104 by passing through or penetrating the impingement device 108.

The impingement device 108 may capable of modifying a flow rate of the heating fluid towards the curing zone 104. The modification of the heating fluid flow F by the impingement device 108 may result in a variable flow of the heating fluid towards the curing zone 104 along the advance direction A. The impingement device 108 may cause the print medium P to be exposed to a variable heating fluid flow F as the print medium P advances in the advance direction A. The impingement device 108 may modify the flow rate of the heating fluid continuously, distinctly, or in a combined manner thereof.

The impingement device 108 may be disposed over the curing zone 104. In some examples, impingement device 108 may expand over at least a part of the print zone 102. The impingement device 108 may have a stationary structural feature that gives rise to the modification of the flow rate of the heating fluid towards the curing zone 104. For example, the impingement device may comprise a plurality of nozzles (not shown). The nozzles may direct or focus the heating fluid flow F towards the curing zone 104. The nozzles may enable a passage for the heating fluid between the fluid flow generator 106 and the curing zone 104. The nozzles may reduce the cross-sectional area for the heating fluid flow F so as to increase the flow speed of the heating fluid flow F.

In an example that the impingement device 108 comprises a plurality of nozzles, at least one of the following may vary along the advance direction: distribution of the plurality of the nozzles; size of the nozzles; and number of the nozzles per unit area. The size of the nozzles may refer to a cross-sectional area of the individual nozzles. For example, the nozzles may have a circular cross-section with the diameter varying along the advance direction.

In some examples, the impingement device may comprise a plate or a wall that is impenetrable for the heating fluid. The plate or wall may comprise openings for the heating fluid to pass through. The openings formed in the plate or wall may be arranged and configured so as to cause the fluid flow of the heating fluid to vary in different areas of the impingement device 108 and/or in different areas of the curing zone 104. Additionally or alternatively, the impingement device 108 may comprise a movable structural or functional feature to modify the flow rate of the heating fluid towards the curing zone 104.

In some examples, the impingement device 108 may divide up the heating fluid flow F into a plurality of partial flows F1 to Fn of the heating fluid as illustrated in FIG. 1. In this example, the partial flows F1 to Fn of the heating fluid are numbered along the advance direction A from a first partial flow F1 to a final partial flow Fn. The number n of the partial flows F1 to Fn may vary between two and several thousands.

The partial flows F1 to Fn may differ from one another in a flow rate of the heating fluid towards the curing zone 104. For example, the partial flows F1 to Fn may differ in total flow rate, or flow rate density. The difference in the flow rate between the partial flows F1 to Fn may be continuous or distinct. The flow rate may refer to a volume flow of the heating fluid per time unit, e.g. sccm or liter per second. The total flow rate may refer to the flow rate summed over a given area, e.g. over a defined portion of a perforated plate of the impingement device. The flow rate density may refer to the flow rate per unit area, e.g. sccm per $mm^2$ or liter per second and per $mm^2$. For example, the flow rate density may represent the division of the total flow rate by the corresponding area.

The partial flows F1 to Fn may cover a respective area of the impingement device 108 and/or of the curing zone 104. The areas covered by the partial flows F1 to Fn may be adjacent or separated from one another. In some examples, each of the areas covered by the partial flows F1 to Fn extends over the entire width of the curing zone 104 and/or the impingement device 108. The areas covered by the partial flows F1 to Fn may differ from one another in position and/or extent in the advance direction A. The area coverage of the individual partial flows F1 to Fn may vary. One of the partial flows F1 to Fn may extend over a first area of the curing zone 104, and another one of the partial flows F1 to Fn may extend over a second area of the curing zone 104, wherein the second area is larger than the first area.

Each of the partial flows F1 to Fn may have a respective total flow rate and a respective flow rate density. The total flow rate and the flow rate densities of at least two of the partial flows F1 to Fn may vary. Accordingly, the impingement device 108 may cause the flow rate density of the heating fluid to vary along the advance direction A.

Figure 2:
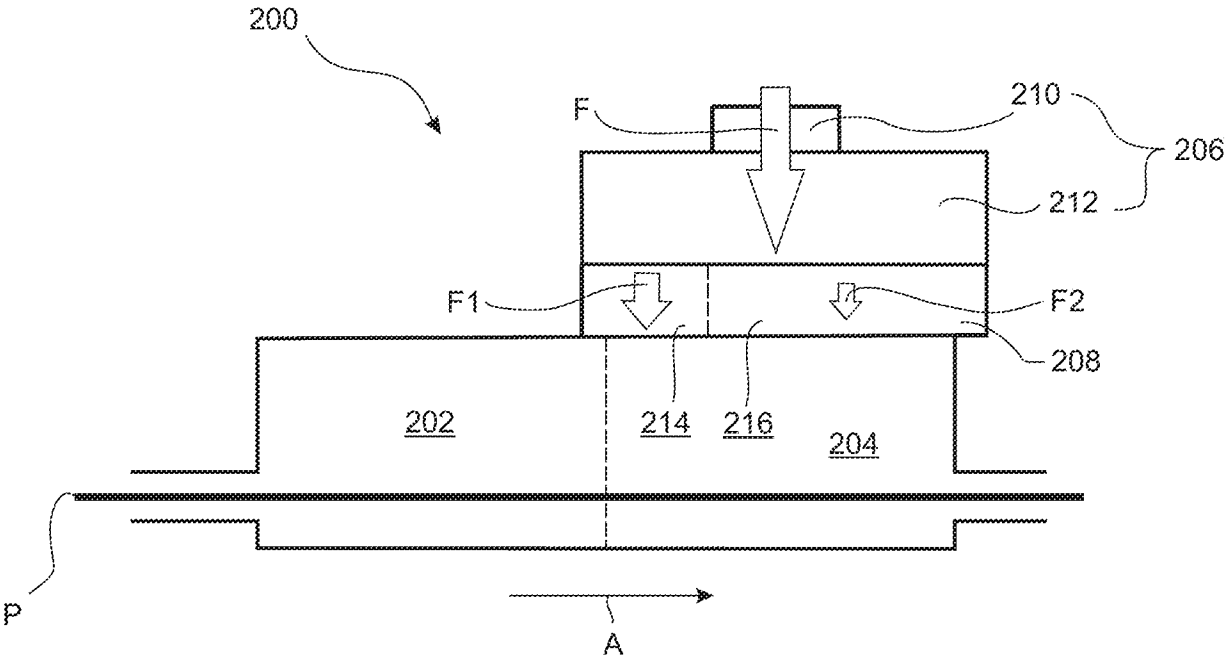
FIG. 2 is a schematic diagram of a printing device according to an example.

FIG. 2 shows a schematic diagram of a printing device 200 according to an example. Unless otherwise indicated in the following, a printing device 200 may comprise at least some of the structural and functional features of the printing device 100 and its elements described above with reference to FIG. 1.

The printing device 200 may comprise a printing zone 202 and a curing zone 204. A print medium P may be moved subsequently through the print zone 202 and the curing zone 204 along the advanced direction A of the print medium P. Accordingly, the curing zone 204 may be arranged downstream of the print zone 202 in terms of the advance direction A.

The print zone 202 and the curing zone 204 may be implemented each in a closed volume, in a semi-closed volume, or in an open volume. The print zone 202 and the curing zone 204 may be openly connected to each other, for example, without a separating structure therebetween, as shown in FIG. 2. Alternatively, print zone 202 and the curing zone 204 may be connected via a conduit or separated by a wall.

The printing device 200 may operate to dispose a print fluid on the surface of a print medium P within the print zone 202. The print fluid may contain pigment particles and additional particles as described above. In the curing zone 204, the print fluid disposed on the surface of the print medium P may be processed such as to induce coalescence of the additional particles, thereby supporting the adhesion of the pigment particles to the surface of the print medium P.

The printing device 200 comprises a fluid flow generator 206 and an impingement device 208, each having features similar or identical to those of the printing device 100 described above. Accordingly, the fluid flow generator 206 may be suitable for generating a heating fluid flow F towards the curing zone 204. For this purpose, the fluid flow generator 206 may comprise a fan 210 to create a negative pressure gradient towards the curing zone 204. The fluid flow generator 206 may comprise an alternative or additional means or device, such as a pump, compressor, or blower, to generate the heating fluid flow F.

Additionally or alternatively, the fluid flow generator 206 may comprise a chamber 212 to receive the heating fluid. The chamber 212 may provide a volume in which the heating fluid is to be processed in a manner suitable for the impingement device 208 to modify the flow rate of the heating fluid. For example, the heating fluid may be heated up to a desired temperature in the chamber 212 using a heating device (not shown in FIG. 2). For example, the heating fluid may be compressed to a desired pressure in the chamber 212 using the fan 210 or any other proper means. Furthermore, a combination of heating and compression of the heating fluid may be performed in the chamber 212. In further examples, the chamber 212 may provide space for otherwise processing the heating fluid, such as acceleration or deceleration, channeling, swirling, depressurizing, or cooling. Additionally or alternatively, the chamber 212 may serve as a conduit for the heating fluid or for a temporary containment.

The printing device 200 further comprises an impingement device 208 arranged upstream of the curing zone 204 in terms of the heating fluid flow F. The impingement device 208 may be arranged downstream of the fluid flow generator 206 in terms of the heating fluid flow F. The fluid flow generator 206, the impingement device 208, and the curing zone 204 may be fluidly connected to one another such as to allow the heating fluid to flow from one to another. For example, the heating fluid may flow from the fluid flow generator 206 to the curing zone 204 by passing through or penetrating the impingement device 208.

The impingement device 208 may comprise a first portion 214 and a second portion 216. The first portion 214 is located upstream of the second portion 216 in terms of the advance direction A of the print medium P. The first and second portions 214, 216 are adjacent and both arranged over the curing zone 204. Either of the first and second portions 214, 216 may extend over the entire width of the impingement device 208, wherein the width may refer to a direction perpendicular to the advance direction A. Furthermore, the width may parallel to the surface of the print medium P when located in the curing zone 204. The areas of the first and second portions 214, 216 may be different. In particular, the first and second portions 214, 216 may differ in the extension in the advance direction A. In the example shown in FIG. 2, the first portion 214 may have a smaller extent in the advance direction A than the second portion 216. In this example, the first portion 214 may cover a smaller area of the impingement device 208, and/or of the curing zone 204, than the second portion 216.

The impingement device 208 may divide up the heating fluid flow F into a plurality of partial flows F1 to Fn as described above. In the example shown in FIG. 2, the first and second portions 214, 216 of the impingement device 208 may create a first partial flow F1 and a second partial flow F2, respectively, upon receiving the heating fluid flow F. The impingement device 208 may comprise a plate or wall impenetrable for the heating fluid.

Figure 3:
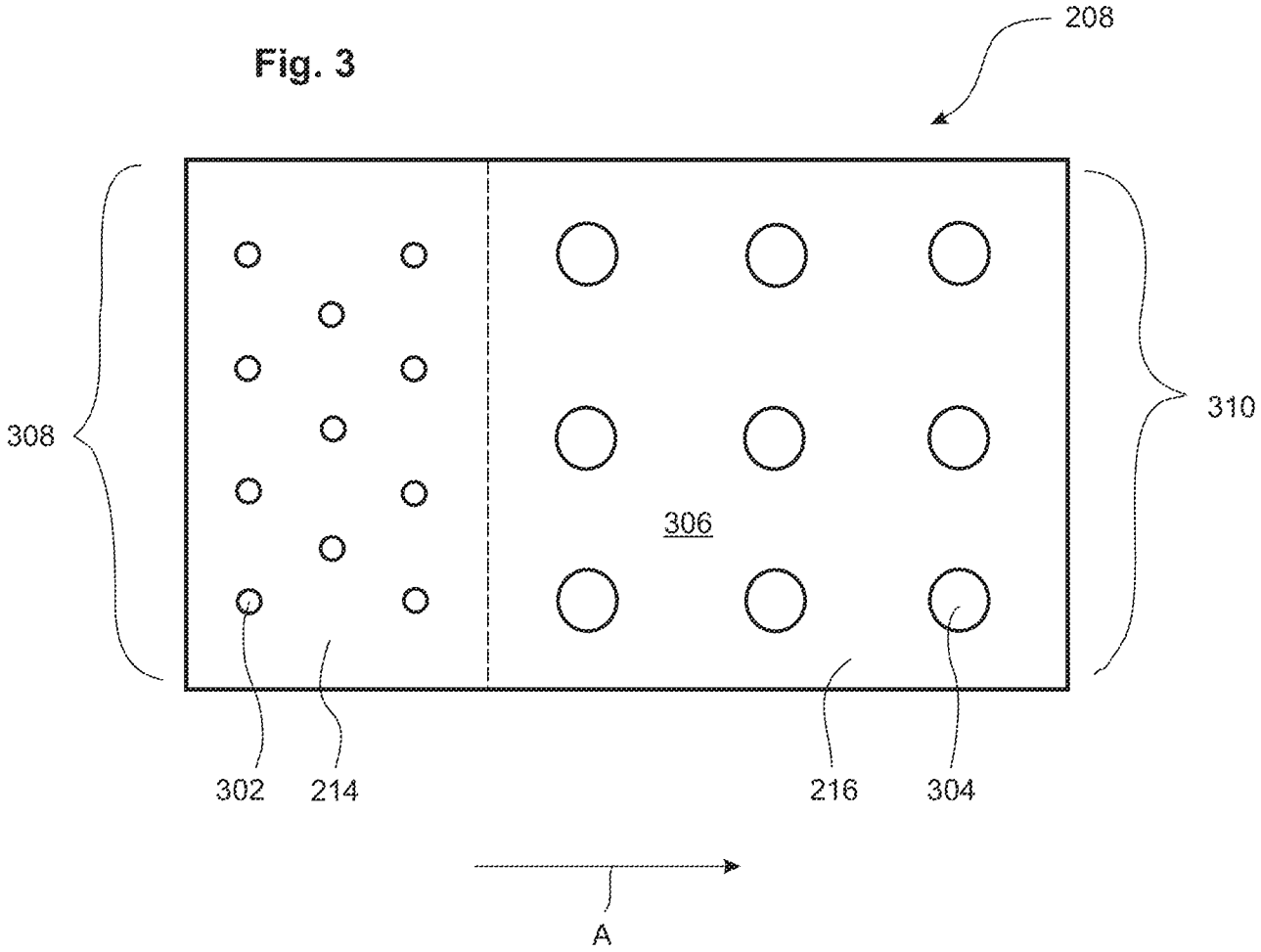
FIG. 3 is a schematic diagram of an impingement device according to an example.

With reference to FIG. 3, a plurality of through-holes 302, 304 may be provided each penetrating through a plate 306 of the impingement device 208. The plate 306 of the impingement device 208 having the through-holes 302, 304 may be considered as a perforated plate.

Each of the through-holes 302, 304 may provide a passage for the heating fluid to flow through the plate or wall 306 of the impingement device 208. The through-holes 302, 304 may be referred to as openings 302, 304. The through-holes 302 in the first portion 214 may be considered as a first group of openings 308, and the through-holes 304 in the second portion 216 may be considered as a second group of openings 310.

As shown in FIG. 2, the first group of openings 308 and the second group of openings 310 may determine the first partial flow F1 and the second partial flow F2, respectively. In some examples, the heating fluid is a compressible fluid, such as air, or any other gas. The total flow rate of the first partial flow F1 may be determined by the cumulated cross-sectional area of the openings 302 of the first group of openings 308. The total flow rate of the second partial flow F2 may be determined by the cumulated cross-sectional area of the openings 304 of the second group of openings 310. The cumulated cross-sectional area of the openings may be referred to as a total size of the openings.

Either one of the first and second groups of openings 308, 310 may be arranged uniformly, for example, according to a geometric pattern. For example, positions of the openings relative to the neighboring openings may be geometrically and/or mathematically defined. For example, spacing between neighboring openings may be constant.

In some examples, the first group of openings 308 may be arranged differently from the second group of openings 310. For example, the first and second groups of openings 308, 310 may be arranged in different patterns. As shown in FIG. 3, the openings 302 of the first group of openings 308 may be arranged in a hexagonal pattern. The openings 304 of the second group of openings 310 may be arranged in columns and rows perpendicular to one another. In further examples, the spatial arrangement of the openings may be arbitrary or according to another geometric pattern. For example, the patterns may include hexagonal, tetragonal, columnar, or concentric patterns, or a combination thereof. The spatial arrangement of the openings may be referred to as distribution of the openings.

In some examples, the first group of openings 308 may be arranged in a more densely manner than the second group of openings 310. The spacing between neighboring openings of the first group of openings 308 may be smaller than the spacing between neighboring openings of the second group of openings 310.

In some examples, the individual size of the openings 302 of the first group of openings 308 may be slightly smaller than the individual size of the openings 304 of the second group of openings 310. The difference in the individual size of the openings 302, 304 may facilitate the first group of openings 308 to be more densely arranged than the second group of openings 310.

In some examples, the number of the openings 302 of the first group of openings 308 may be different from the number of openings 304 of the second group of openings 310. As shown in FIG. 3, the first group of openings 308 may include a less number of openings than the second group of openings 310. The total size of the openings of each group of openings may be determined by the individual size and the number of the respective openings. For example, the product of the individual size of the openings and the number of the openings may correspond to the total size of the openings, which determines the respective total flow rate through these openings.

In some examples, the openings of either one of the first and second groups of openings 308, 310 may have a uniform cross-section, i.e. with the same shape and size. For example, the openings of either group of openings they have a circular cross-section, and the individual size of the openings is defined by the diameter of the circular cross-section. As shown in FIG. 3, the openings 302 of the first group of openings 308 may have a smaller individual size than the openings 300 for the second group of openings 310.

The density of the openings 302, 304, the individual size of the openings 302, 304, the number of the openings 302, 304, or any combination thereof, may determine the respective flow rate density of the partial flows F1, F2 of the heating fluid flow F created within the respective portion 214, 216 of the impingement device 208.

Figure 4:
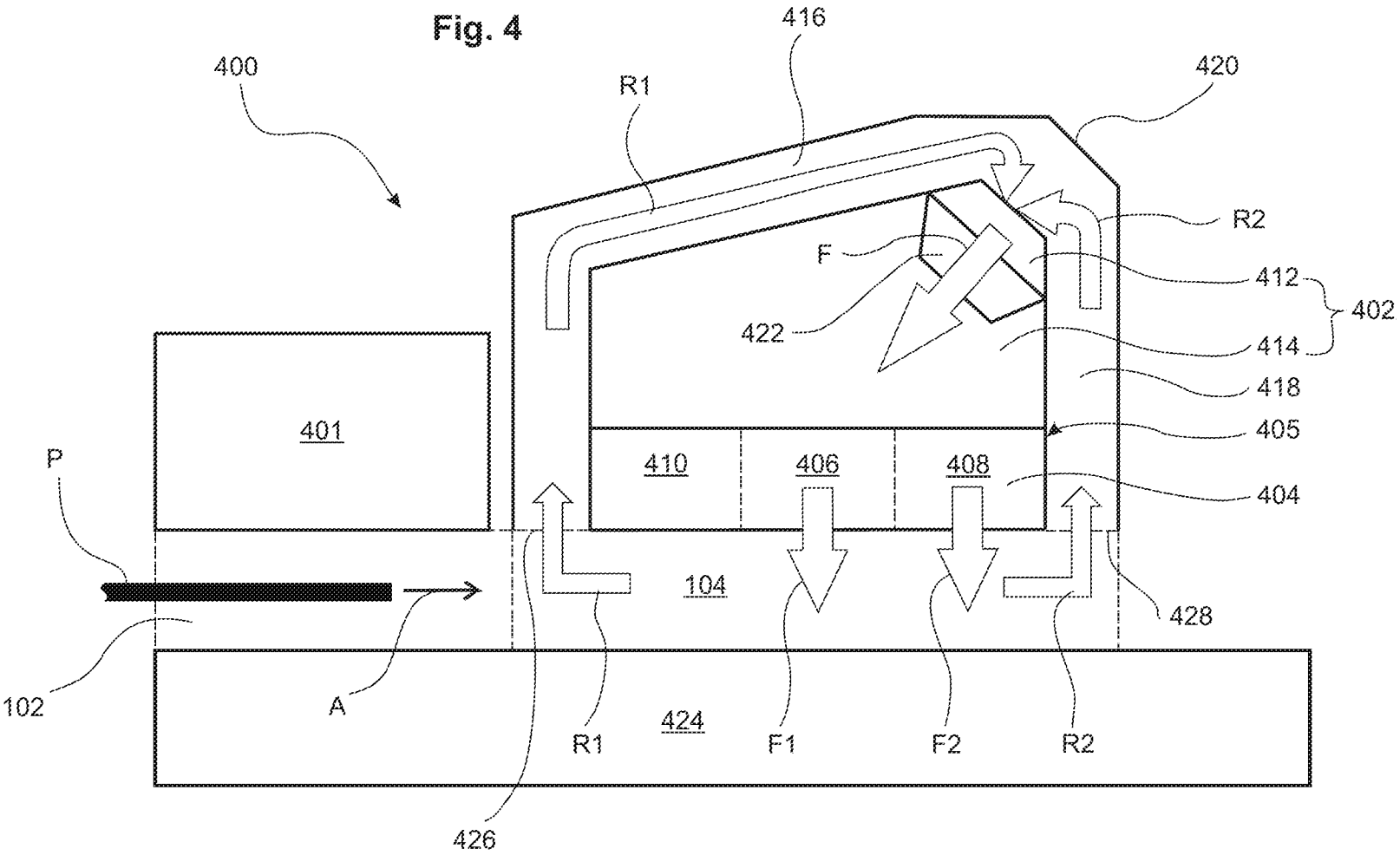
FIG. 4 is a schematic diagram of a printing device according to an example.

FIG. 4 shows a schematic diagram of a printing device 400 according to an example. The printing device 400 comprises a fluid flow generator 402 and an impingement device 404. As shown in FIG. 4, the printing device 400 comprises, or is disposed over, a print zone 102 and a curing zone 104. The functional and structural features of any of the printing device 400, the fluid flow generator 402 and the impingement device 404 may correspond to the above description with any of the printing devices 100, 200 and the impingement device 208 with reference to FIG. 1 to 3, unless otherwise indicated.

In some examples, the printing device 400 comprises a print fluid disposal device 401. The print fluid disposal device 401 may include, for example, print heads mounted on a carriage movable along a direction perpendicular to an advance direction A of a print medium P. The print fluid disposal device 401 may operate to dispose print fluid on the surface of the print medium P according to an image to be printed. The print fluid may comprise pigment particles and additional particles as described above.

The fluid flow generator 402 may cause a heating fluid, e.g. air, to flow towards the curing zone 104 arranged downstream of the print zone 102 in terms of an advance direction A of a print medium P. The fluid flow generator 402 may create a heating fluid flow F as shown in FIG. 4. The impingement device 404 may be arranged upstream of the curing zone 104 in terms of the heating fluid flow F. The impingement device 404 may modify a flow rate of the heating fluid towards the curing zone 104 along the advance direction A in the above-described manner.

The impingement device 404 may comprise a perforated plate 405 comprising a first portion 406 a second portion 408 and a third portion 410. The first portion 406 and the second portion 408 may comprise openings (not shown in FIG. 4) similar to the description above. The openings may be through-holes formed between a top surface and a bottom surface of the perforated plate 405.

The first portion 406 and the second portion 408 may create a first partial flow F1 and a second partial flow F2 in the above-described manner with reference to FIGS. 2 and 3. The third portion 410, which is located proximal to the print zone 102, may be entirely impenetrable for the heating fluid.

The fluid flow generator 402 may comprise a fan 412 and a chamber 414. The fluid flow generator 402 as well as its fan 412 and chamber 414 may comprise the functional and structural features as described above with reference to FIG. 2. The fan 412 may operate to blow the heating fluid towards the curing zone 104. For example, the fan 412 may operate to intake the heating fluid from a front fluid conduit 416 and a rear fluid conduit 418, which are formed along outer walls of the perforated plate 405 and the chamber 414 and enclosed by a housing 420. The fan 412 may operate to blow the heating fluid into the chamber 414, thereby increasing the pressure of the heating fluid therein.

Furthermore, the printing device 400 may comprise a heating device 422 to heat the heating fluid upstream of the curing zone 104 in terms of the heating fluid flow F. The heating device 422 may heat the heating fluid to, or above, a curing temperature. For example, the curing temperature is 30-200° C., or 40-150° C., or 50-100° C. In some examples, the heating device 422 may comprise a coil heater to heat the heating fluid while passing through. For example, the coil heater may have a hollow portion through which the heating fluid may pass.

The chamber 414 may be closed by the perforated plate 405 at the bottom. With the third portion 410 of the perforated plate 405 being impenetrable for the heating fluid, the heating fluid within the chamber 414 may be conducted through the openings of the first portion 406 and the second portion 408. The heating fluid may be accelerated and/or channeled towards the curing zone 104 during this process in the above described manner. This process may be referred to as impingement. This impingement of the heating fluid may be used for the coalescence of the additional particles as discussed above.

The openings formed in the first portion 406 may be arranged in a denser manner than the openings formed in the second portion 408. The openings in the first portion 406 may have the same individual size as, or a smaller individual size than, the openings in the second portion 408. In some examples, the ratio of the number of the openings in the first portion 406 to the number of the openings in the second portion 408 may be near parity, i.e. nearly the same, or 0.9 to 1.1, or 0.8 to 1.25, or 0.5 to 2. In other examples, the number of the openings in the first portion 406 is multiple times of the number of the openings in the second portion 408. In yet other examples, the number of the openings in the second portion 408 is multiple times of the number of the openings in the first portion 406.

In some examples, the openings in the first portion 406 and the openings in the second portion 408 may be arranged such that the first partial flow F1 of the heating fluid through the first portion 406 has a higher flow rate density than the second partial flow F2 of the heating fluid through the second portion 408. Accordingly, the impingement of the heating fluid towards the curing zone 104, or towards the print medium P if located therein, is more intense in an area below the first portion 406 than in an area below the second portion 408. For example, the impingement of the heating fluid corresponding to the first portion 406 may serve quick heating the print medium P, or the print fluid disposed on the surface thereof, to a desired temperature, which may referred to as the curing temperature. For example, the impingement of the heating fluid corresponding to the second portion 408 may serve maintaining the print medium P, or the print fluid disposed on the surface thereof, at a desired temperature, e.g. at the curing temperature. The desired temperature or the curing temperature may be chosen as described above.

Accordingly, the print medium P, or the print fluid disposed thereupon, may be exposed to different intensities of heating fluid impingement when advancing through the curing zone 104 in the advance direction A. Parameters including the size of the openings, the arrangement of the openings in terms of location, pattern or density, and the coverage area may be chosen according to individual printing tasks. For example, the individual printing tasks may relate to the individual images to be printed. For example, the individual printing tasks may relate to different print media in terms of the material, surface properties, size, thickness or rigidity.

Further parameters may include the heating performance of the heating device 422 and the work performance of the fluid flow generator 402, or the fan 412. For example, the parameters may be selected such that the heating fluid impingement through the first portion 406 allows for time-efficiently increasing the temperature of the print medium P, or the print fluid disposed thereupon, to a desired temperature in a uniform manner over the entire depth of the print fluid disposed. For example, the parameters may be selected such that the heating fluid impingement through the second portion 408 allows for effectively maintaining the desired temperature at the print medium P, or the print fluid disposed thereupon, for a duration that is sufficient for the coalescence of the additional particles.

The printing device 400 may further comprise a platen 424 to support the print medium P within the curing zone 104. The platen 424 may further support the print medium P within the print zone 102. The platen 424 may support the print medium P so as to provide a even surface to be printed on.

For example, the print medium may be made from paper, cardboard, synthetic material, wood, metal, glass, rubber, or the like, or any combination thereof. For example, the print medium P may be of any elasticity. For example, the print medium P may have a thickness of 0.01 to 300 mm, or 0.1 to 200 mm, or 0.12 to 100 mm.

A part of the heating fluid in the curing zone 104 may further flow opposite to the advance direction A towards the front fluid conduit 416, as indicated by arrow R1. A part of the heating fluid in the curing zone 104 may further flow in the advance direction A towards the rear fluid conduit 418, as indicated by arrow R2. For example, the fluid flow generator 402, or the fan 412, may cause the heating fluid to flow towards a front intake 426 or a rear intake 428 fluidly connected to the front fluid conduit 416 and the rear fluid conduit 418, respectively. A part of the heating fluid may be intaken at the front intake 426 and conducted into the front fluid conduit 416. A part of the heating fluid may be intaken at the rear intake 428 and conducted into the rear fluid conduit 418. The intaken heating fluid may be conducted by and towards the fluid flow generator 402, or the fan 412, and re-heated by the heating device 422. Accordingly, the heating fluid may be partially re-harvested and repeatedly used for impingement. The power consumption of the printing device 400 may be reduced in this manner.

With reference to FIG. 4, the printing device 400 may have a printing system, in which the print fluid is disposed on the print medium P. For example, the printing system may comprise the print fluid disposal device 401. The print fluid may comprise a polymer component to coalesce when exposed to the heating fluid at the curing temperature. The heating fluid may be heated to the curing temperature or above by the heating device 422 as described above.

The printing device 400 may comprise a curing system in which the print medium P is exposed to the heating fluid flow at the curing temperature. The curing system may encompass, or be included by, the curing zone 104. The heating fluid flow may be generated by the fluid flow generator 402 as described above. The curing system may comprise the impingement system 404 to modify a flow rate of the heating fluid towards the print medium P along the advance direction A. The modification of the flow rate of the heating fluid may relate to modifying the total flow rate, the flow rate density, or the combination thereof.

The printing device 400 may comprise a transport system to move the print medium P from the printing system to the curing system, or from the print zone 102 to the curing zone 104. For example, the transport system may to convey the print medium in the advance direction A. The transport system may involve belts, rollers, chains, or the like, or the combination thereof, to convey the print medium P in the advance direction A.

Figure 5:
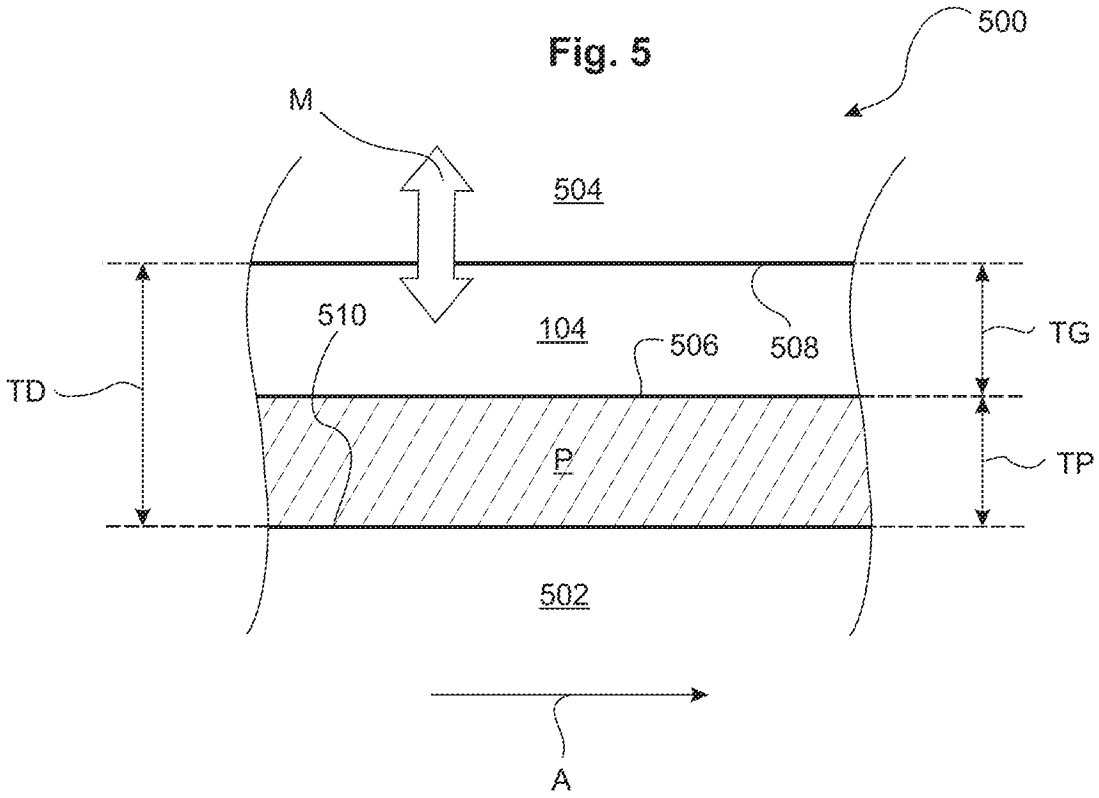
FIG. 5 is a schematic diagram of a partial view of a printing device according to an example.

FIG. 5 shows a schematic diagram of a partial view of a printing device 500 according to an example. Unless indicated otherwise, the printing device 500 may comprise any of the structural and functional features of the printing devices 100, 200 or 300 as described above with reference to FIG. 1 to 4.

As shown in FIG. 5, the printing device 500 may comprise a platen 502 arranged in the curing zone to support the print medium P, and an impingement device 504. The impingement device 504 may have a plate-like shape. The impingement device 504 may be arranged over and parallel to the platen 502. Unless otherwise indicated, the impingement device 504 may have any of the structural and functional features of the impingement devices described with reference to FIG. 1 to 4.

The print medium P may have a thickness TP of 0.1 to 300 mm, or any other thickness as indicated above. The print medium P, being supported by the platen 502, may have an even top surface 506. The impingement device 504 may be arranged such that a gap TG between the top surface 506 of the print medium P and a bottom surface 508 of the impingement device 504 is 0.01 to 100 mm, or 0.05 to 50 mm, or 0.1 to 30 mm.

The impingement device 504 may be movable in a direction perpendicular to the advance direction A of the print medium P. For example, the impingement device 504 may be movable as indicated by arrow M in FIG. 5. For example, a distance TD between the bottom surface 508 of the impingement device 504 and a top surface 510 of the platen 502 may be adjustable. The distance TD may be adjustable in a range of 0.01 to 500 mm, or 0.01 to 400 mm, or 0.1 to 350 mm. In some examples, at least two of the top surface 510 of the platen 502, the bottom surface 508 of the impingement device 504, and the top surface 506 of the print medium P may be arranged parallel to one another within the curing zone 104. The movement of the impingement device 504 perpendicular to the advance direction A may be performed by an electric motor, a solenoid actuator, or the like, or any combination thereof.

With the impingement device 504 being movable perpendicular to the advance direction A of the print medium P, the printing device 500 allows for printing on print media of various thicknesses. The impingement device 504 being movable may allow for adapting the gap TG to different materials of the print medium P. Thus, different material properties may be taken into account for the heating fluid impingement.

Figure 6:
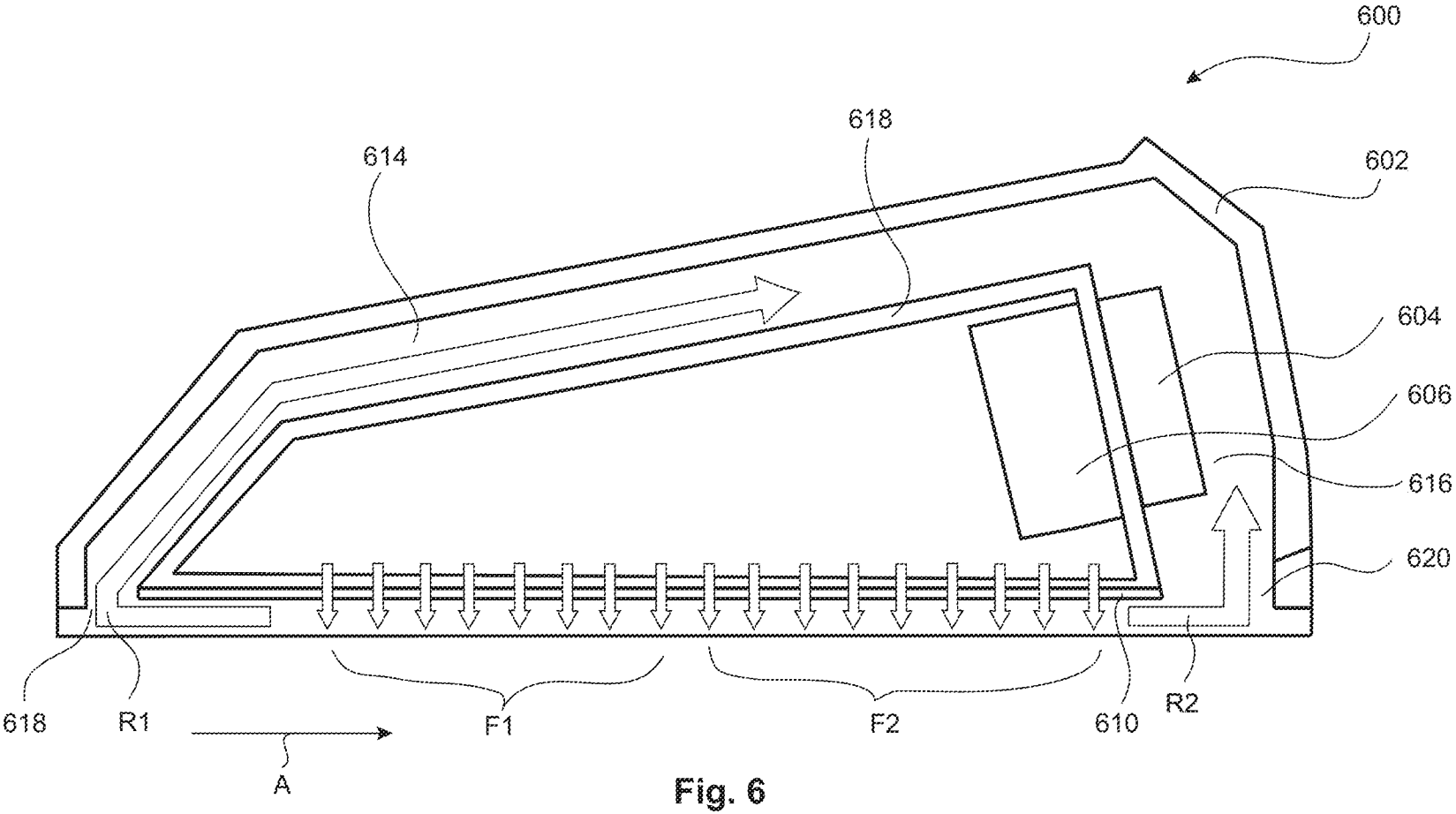
FIG. 6 is a schematic diagram of a printing device according to an example.

FIG. 6 shows a schematic diagram of a printing device 600 according to an example. Unless indicated otherwise, the printing device 600 may comprise any of the structural and functional features of the printing devices as described above with reference to FIG. 1 to 5.

The printing device 600 may comprise a housing 602, a fan 604, a heating coil 606, a pressure chamber 608, and an impingement device 610. The printing device 600 may further comprise recirculation conduit 612 comprising a front conduit 614 and a rear conduit 616 fluidly connected to each other and to the fan 604. The recirculation conduit 612 is formed along an outer surface of a housing 618 of the pressure chamber 608.

Either the fan 604 or a combination including the fan 604 and the pressure chamber 608 may be considered as a fluid flow generator to cause a heating fluid to flow towards a curing zone that is downstream of a print zone in terms of an advance direction of the print medium P. The heating fluid may be as described above and, for example, a gas including air. The curing zone and the print zone may be as described above. The impingement device 610 may be arranged upstream of the curing zone in terms of the heating fluid flow. The impingement device 610 may be capable of modifying a flow rate of the heating fluid towards the curing zone along the advance direction.

Figure 7:
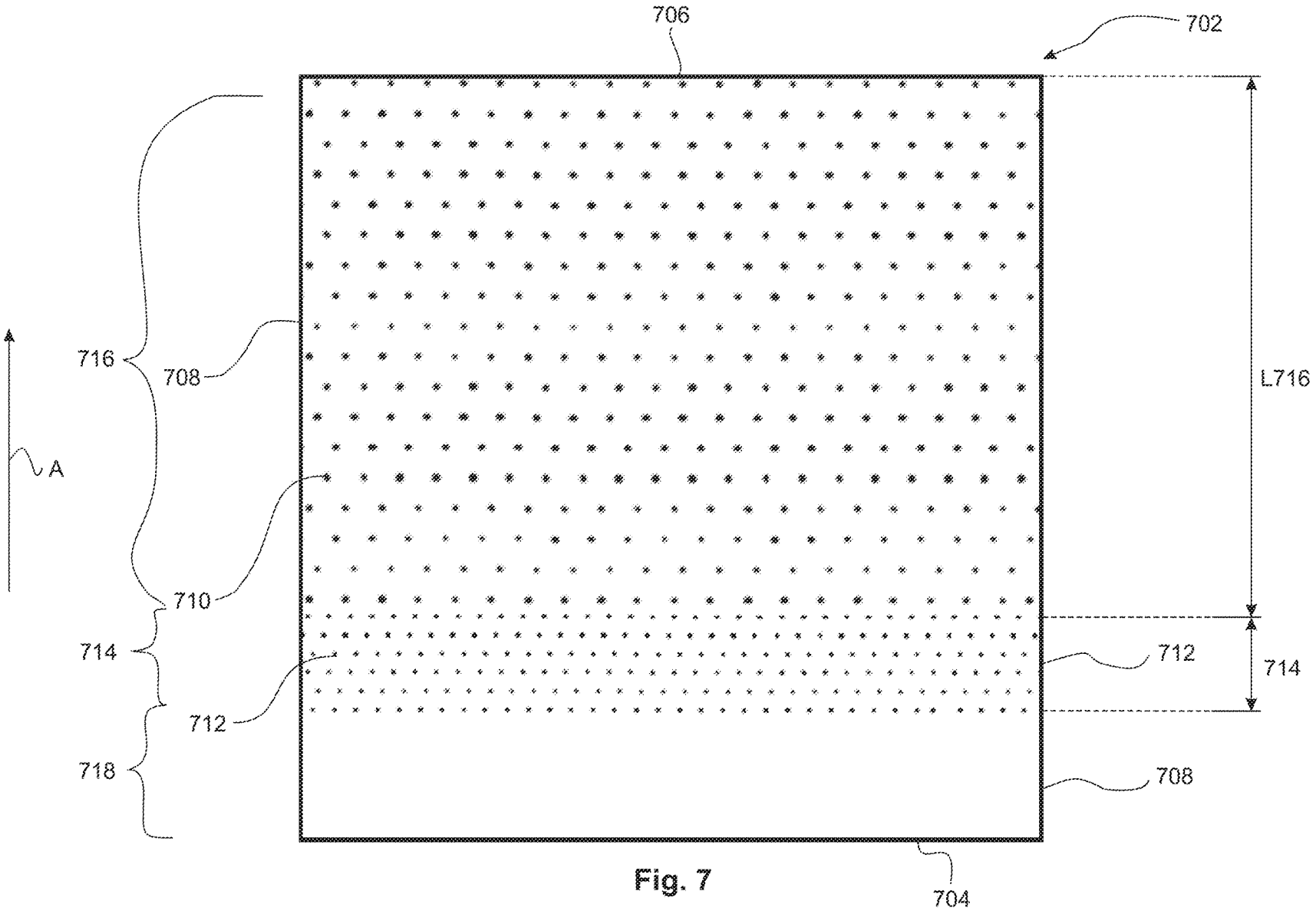
FIG. 7 is a schematic diagram of an impingement device according to an example.

FIG. 7 shows a schematic diagram of a top view of the impingement device 610 according to an example. The impingement device 610 may comprise a perforated plate 702 having a front end face 704, a rear end face 706, and side faces 708. The front end face 704 of the perforated plate 702 may be to be located proximal to a print zone, e.g. the print zone 102 as shown in FIG. 1, 2 or 4.

The perforated plate 702 has a first group of openings 710 and a second group of openings 712. Each opening of the first and second groups of openings 710, 712 may be such as to provide the heat fluid to flow through towards the curing zone. The openings of the first group of openings 710 may be uniformly distributed in a first portion 714 of the perforated plate 702. The openings of the second group of openings 712 may be uniformly distributed in a second portion 716 of the perforated plate 702. The second portion 716 may be located downstream of the first portion 714 in terms of the advance direction A. An areal density of the openings in the first portion 714 may be higher than an areal density of the openings in the second portion 716.

In some examples, the perforated plate 702 may comprise a blank portion 718 be-tween the front end face 704 and the first portion 712. The perforated plate 702 may be pro-vided as one single piece or as an assembly of multiple modules (not shown). In examples where the perforated plate 702 is an assembly of multiple modules, at least one joining line between the modules may be tilted with respect to the front end face 704 or the side faces 708. The tilted joining may contribute to preventing the occurrence of undesired lines in print products.

The first portion 714 may extend to a first length L714 along the advance direction A. The second portion 716 may extend to a second length L716 along the advance direction A. For example, a ratio of the first length L714 to the second length L716 may be 0.1 to 0.9, or 0.2 to 0.8, or 0.3 to 0.7.

Referring back to FIG. 6, the fluid flow generator, or the fan 604, may operate to apply an increased pressure to the heating fluid on a first side of the perforated plate which is facing away from the curing zone. The printing device 600 may operate to cause the heating fluid to flow towards the curing zone at a flow velocity of 5 to 50 meters per second, or 10 to 40 meters per second, or 15 to 30 meters per second. For this purpose, selected parameters may be configured accordingly. For example, the parameters may include: (1) diameter of the openings of the first and second groups of openings 710, 712; (2) size of the openings in the first and second groups of openings 710, 712; (3) areal densities of the openings of the first and second groups of openings 710, 712; and (4) the increased pressure. In some examples, at least two of the parameters (1) to (4) are configured in combination to create the desired flow velocity of the heating fluid.

The front and rear conduits 614, 616 may form part of a heating fluid circuit. The heating fluid circuit may be provided to intake the heating fluid downstream of the curing zone in terms of the heating fluid flow. The locations of intaking may be at either of a front intake 618 and a rear intake 620, as indicated by arrows R1, R2. The heating fluid circuit may allow for maintaining the flow of the heating fluid. The heating fluid flow towards the curing zone may be re-harvested and reused for impingement, as discussed above. The fluid flow generator, for example, the fan 604, may be coupled to the heating fluid circuit. In some examples, the heating coil 606, and the pressure chamber 608 may form part of the heating fluid circuit. The heating fluid circuit may operate to cause the heating fluid to re-flow towards the curing zone, for example, in the above-described manner.

Figure 8:
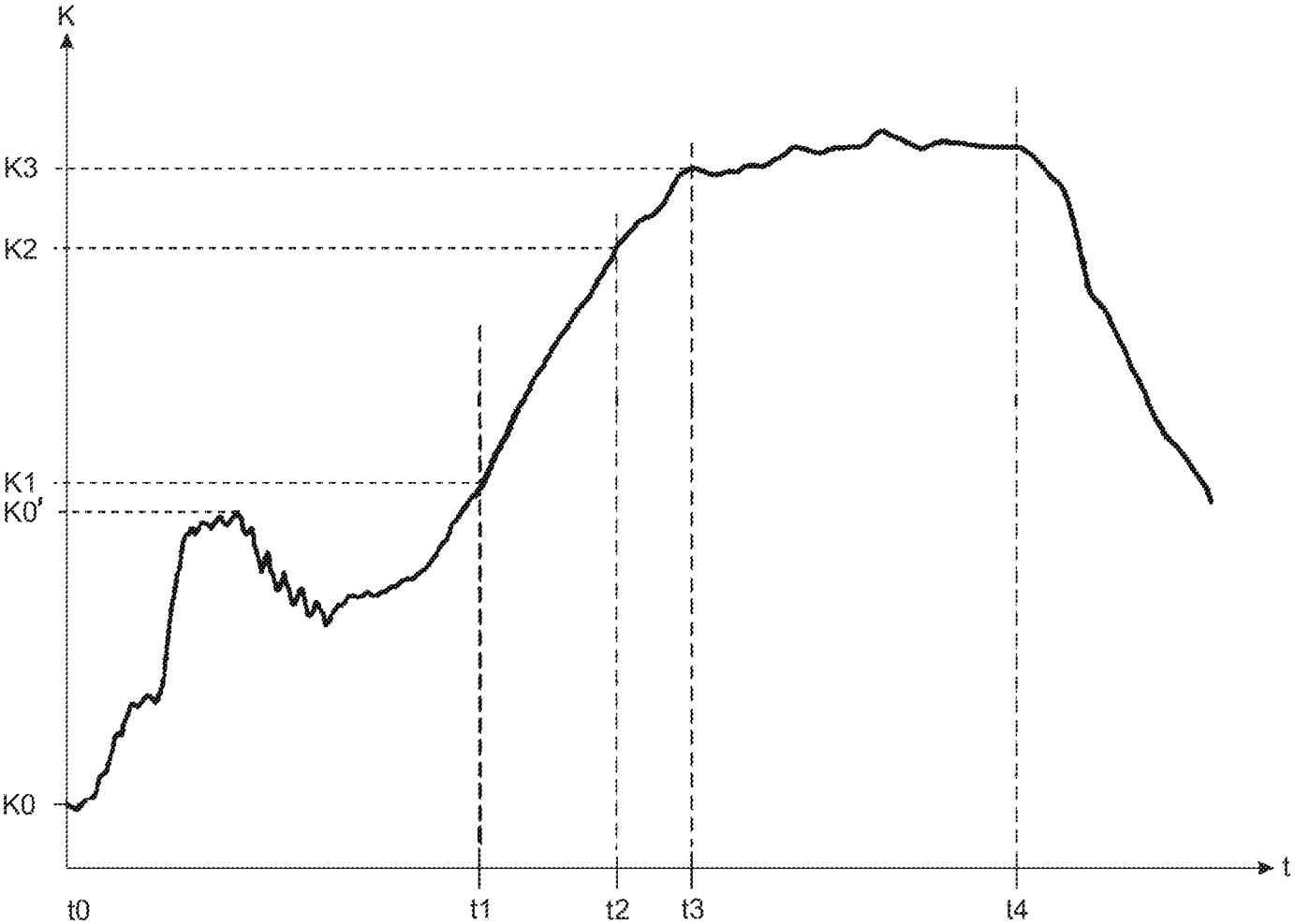
FIG. 8 is a schematic diagram illustrating the temperature change of the print medium according to an example.

FIG. 8 shows a schematic diagram illustrating the temperature change of the print medium P when processed by a printing device according to an example. For example, the diagram of FIG. 8 may show the temperature change when using any of the printing devices as described above with reference to FIG. 1 to 7. In the following, the diagram of FIG. 8 is explained with reference to the printing device 600 and the perforated plate 702 shown in FIGS. 6 and 7.

In FIG. 8, the vertical axis may indicate the temperature K at the print medium P. The horizontal axes in FIG. 8 may indicate time t elapsed. Both vertical and horizontal axis may be shown in arbitrary or relative units.

A starting point at to may indicate the print medium P entering a print zone, e.g. the print zone 102 as described above. The corresponding temperature K0 may indicate the starting temperature of the print medium, e.g. corresponding to ambient temperature.

From t0 to t1, the print medium P may undergo a process of printing, in which print fluids may be disposed on the surface of the print medium P. In some examples, a process of drying may be performed in which water contents from the surface of the print medium P and the print fluid disposed thereupon at least partially evaporate. The temperature K may change from K0 over K1 to K2 due to the processes of printing and drying.

The print medium P may enter the curing zone at t1. In some examples, the impingement device has a hole-free portion proximal to the print zone. The temperature K may increase from K1 to K2 due to the heating fluid circulating from the first or second portion 714, 716 towards the front intake 618.

The print medium P may enter an area below the first portion 714 at t2. The time period from t2 until t3 may indicate the print medium P traversing the area below the first portion 714. The temperature K may increase, in a relatively rapid manner, from K2 to K3 due to the dense impingement of the heating fluid onto the print medium P. The resulting temperature K3 may be a desired temperature for inducing the coalescence of the additional particles in the print fluid. For example, the temperature K3 may be referred to as the curing temperature. The temperature K3 may be as described above with respect to the curing temperature.

The print medium may enter an area below the second portion 716 at t3. The time period from t3 until t4 may indicate the print medium P traversing the area below the second portion 716. The temperature K may remain relatively constant at, or within a tolerable or negligible range from, the curing temperature K3. The temperature K3 may be maintained for the time period from t3 until t4. This time period may correspond to a duration suited for the coalescence of the additional particles in the entire thickness of the print fluid disposed upon the print medium P.

The print medium P may exit the area below the second portion 716 at t4. As the print medium P abandons the area of impingement, the print medium P cools down and the temperature K drops from around K3.

Figure 9:
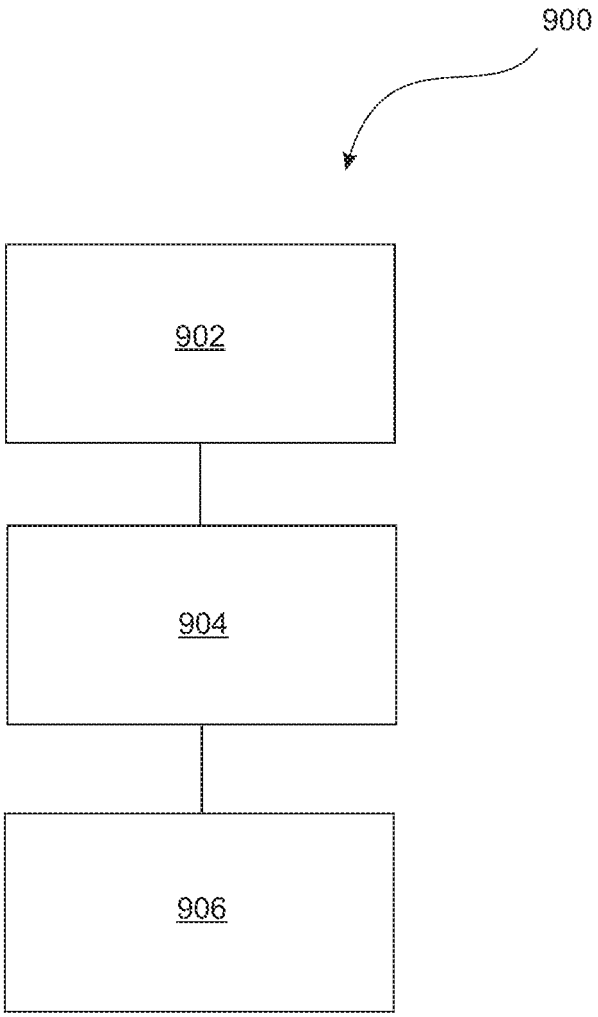
FIG. 9 is a flow chart of a method according to an example.

FIG. 9 shows a flow chart of a method 900 according to an example. The method 900 may be applicable to any of the printing devices described above with reference to FIG. 1 to 8.

At 902, a heating fluid, for example, a gas including ambient air, may be heated up to a curing temperature. The curing temperature may refer to the additional particles contained in a print fluid as discussed above.

At 904, the method 900 may cause a heating fluid to flow to a print medium processing zone through which a printed medium having a print fluid disposed thereon passes.

The print medium may correspond to the print medium P as described above. The print medium processing zone may correspond to a curing zone, for example the curing zone 104 as described above.

At 906, a flow rate of the heating fluid towards the print medium processing zone may be modified as the print medium passes through the print medium processing zone. The modification of the flow rate of the heating fluid may be performed using an impingement device as described above.

The method described above is only an illustrative example. A number of modifications could be made to the method. For example, blocks could be added, reordered, combined, or eliminated. The arrangement of the blocks does not imply a particular order.

The preceding description has been presented only to illustrate and describe examples of the principles described. This description is not intended to be exhaustive or to limit these principles to any precise form disclosed. Many modifications and variations are possible in light of the above teaching.

The invention claimed is:

1. A printing device, comprising:

a fluid flow generator to cause a heating fluid to flow towards a curing zone that is downstream of a print zone in terms of an advance direction of the print medium; and an impingement device arranged upstream of the curing zone in terms of the heating fluid flow, wherein the impingement device comprises a plurality of openings, each opening forming a nozzle, each nozzle to focus the flow of the heating fluid towards the curing zone, wherein the nozzles of the impingement device vary in size along the advance direction so as to modify a flow rate of the heating fluid towards the curing zone along the advance direction, the impingement device delivering a different flow rate to the print medium at a beginning of the curing zone than at an exit of the curing zone because of the variation in nozzle size.

2. The printing device of claim 1, wherein at least one of the following varies within the curing zone along the advance direction:

a distribution of the plurality of nozzles; and a number of the plurality of nozzles per unit area.

3. The printing device of claim 1, wherein the impingement device comprises a perforated plate having a first group of openings and a second group of openings, wherein the openings of the first group of openings are uniformly distributed in a first portion of the perforated plate, wherein the openings of the second group of openings are uniformly distributed in a second portion of the perforated plate that is located downstream of the first portion in terms of the advance direction, wherein an areal density of the openings in the first portion is higher than an areal density of the openings in the second portion.

4. The printing device of claim 3, wherein the first portion extends to a first length along the advance direction of the print medium, wherein the second portion extends to a second length along the advance direction of the print medium, wherein a ratio of the first length to the second length is 0.1 to 0.9, or 0.2 to 0.8, or 0.3 to 0.7.

5. The printing device of claim 3, wherein the fluid flow generator is to apply an increased pressure to the heating fluid on a first side of the perforated plate facing away from the curing zone, wherein at least two of the following parameters in combination are configured such that the heating fluid flows towards the curing zone at a flow velocity of 5 to 50 meters per second, or 10 to 40 meters per second, or 15 to 30 meters per second:

diameter of the openings of the first and second groups of openings, size of the openings in the first and second groups of openings;

the areal densities of the openings of the first and second groups of openings, and the increased pressure.

6. The printing device of claim 1, wherein the impingement device is movable in a direction perpendicular to the advance direction.

7. The printing device of claim 1, further comprising:

a heating device to heat the heating fluid to a curing temperature upstream of the printing medium curing zone in terms of the heating fluid flow, wherein the curing temperature is 30 to 200° C., or 40 to 150° C., or 50 to 100° C.

8. The printing device of claim 1, wherein at least a portion of the openings of the impingement device along the advance direction are arranged in columns and rows perpendicular to one another.

9. The printing device of claim 1, wherein the fluid flow generator comprises a fan to blow the heating fluid towards the curing zone.

10. The printing device of claim 1, wherein the impingement device comprises a perforated plate with a blank portion having no openings, a second portion having openings of a first size and a third portion having openings of a second, larger size, the blank portion being arranged first in the advance direction, followed by the second portion and then the third portion.

11. The printing device of claim 1, wherein the heating fluid is air.

12. The printing device of claim 1, further comprising a platen arranged in or at the curing zone to support the print medium, wherein the impingement device is plate-shaped and arranged over and parallel to the platen.

13. The printing device of claim 1, further comprising a heating fluid circuit to intake the heating fluid downstream of the curing zone in terms of the heating fluid flow, the heating fluid circuit to maintain the flow of the heating fluid, wherein the fluid flow generator is coupled to the heating fluid circuit, wherein the heating fluid circuit is to cause the heating fluid to re-flow towards the curing zone.

14. The printing device of claim 1, wherein the impingement device is to modify the flow rate of the heating fluid such that relatively less heating fluid flow is directed to a second part of the curing zone as compared to a first part of the curing zone, the second part of the curing zone being further along the advance direction than the first part of the curing zone.

15. The printing device of claim 1, wherein a size of the plurality of nozzles varies monotonically from smaller to larger within the curing zone along the advance direction.

16. A printing device, comprising:

a printing system in which a print fluid is disposed on a print medium, wherein the print fluid comprises a polymer component to coalesce when exposed to a heating fluid at a curing temperature;

a curing system in which the print medium is exposed to a flow of a heating fluid at the curing temperature, the flow of the heating flow generated by a fluid flow generator;

a transport system to move the print medium from the printing system to the curing system;

wherein the curing system comprises an impingement system to modify a flow rate of the heating fluid towards the print medium along the advance direction, the impingement system to generate more than two different flow rate zones of heating fluid as the print medium moves along the advance direction such that relatively less heating fluid flow is directed to a point on the print medium as that point advances through the different flow rate zones; and wherein the impingement device comprises a perforated plate with a blank portion having no openings, a second portion having openings of a first size and a third portion having openings of a second, larger size, the blank portion being arranged first in the advance direction, followed by the second portion and then the third portion, the blank portion being as large or larger than the second portion in the advance direction.

17. The printing device of claim 16, wherein a difference in flow rates among the different flow rate zones is continuous along the advance direction.

18. The printing device of claim 16, wherein a length of the second portion in the advance direction compared to a length of the third portion in the advance direction has a ratio of 0.3 to 0.7.

* * * * *